US010689738B2

(12) United States Patent
Foster et al.

(10) Patent No.: US 10,689,738 B2
(45) Date of Patent: Jun. 23, 2020

(54) PROCESS FOR FORMING ALUMINIUM ALLOY SHEET COMPONENTS

(75) Inventors: Alistair Foster, Worcester (GB); Trevor A. Dean, Birmingham (GB); Jianguo Lin, London (GB)

(73) Assignee: Imperial Innovations Ltd., London (GB)

( * ) Notice: Subject to any disclaimer, the term of this patent is extended or adjusted under 35 U.S.C. 154(b) by 1339 days.

(21) Appl. No.: 13/119,149

(22) PCT Filed: Sep. 16, 2009

(86) PCT No.: PCT/GB2009/002209
§ 371 (c)(1),
(2), (4) Date: Jan. 19, 2012

(87) PCT Pub. No.: WO2010/032002
PCT Pub. Date: Mar. 25, 2010

(65) Prior Publication Data

US 2012/0152416 A1 Jun. 21, 2012

(30) Foreign Application Priority Data

Sep. 19, 2008 (GB) ..... 0817169.6

(51) Int. Cl.
*C22F 1/00* (2006.01)
*C22F 1/04* (2006.01)
(Continued)

(52) U.S. Cl.
CPC ..... *C22F 1/00* (2013.01); *C22F 1/04* (2013.01); *C22F 1/06* (2013.01); *C22F 1/10* (2013.01); *C22F 1/18* (2013.01)

(58) Field of Classification Search
CPC .... C22F 1/04; C22F 1/00; C22F 1/002; C22F 1/05; C22F 1/053; C22F 1/057
See application file for complete search history.

(56) References Cited

U.S. PATENT DOCUMENTS 5,019,183 A 5/1991 Martin
5,769,972 A 6/1998 Sun et al.
2007/0209739 A1* 9/2007 Zhao ..... B22D 11/0605 148/551

FOREIGN PATENT DOCUMENTS

JP 2004315913 A2 11/2004
JP 2006299295 A2 11/2006
(Continued)

OTHER PUBLICATIONS

Garrett, R.P "Solution Heat Treatment and Cold Die Quenching in Forming AA 6xxx Sheet Components: Feasability Study", Advanced Materials Research, May 2005, vols. 6-8 pp. 673-680.*
(Continued)

*Primary Examiner* — George Wyszomierski
*Assistant Examiner* — Janell C Morillo
(74) *Attorney, Agent, or Firm* — Brooks Kushman P.C.

(57) ABSTRACT

The method relates to a method of forming an Al-alloy sheet component. The method comprises heating an Al-alloy sheet blank to its Solution Heat Treatment temperature at a heating station and, in the case of alloys not in a pre age hardened temper, maintaining the SHT temperature until Solution Heat Treatment is complete. The sheet blank is then transferred to a set of cold dies and forming is initiated within 10 s of removal from the heating station so that heat loss from the sheet blank is minimised. The cold dies are closed to form the sheet blank into a shaped component, said forming occurring in less than 0.15 s, and the formed component is held in the closed dies during cooling of the formed component. The claimed method will find application for any Aluminium alloy with a microstructure and mechanical properties that can be usefully modified by solution treatment and age-hardening.

14 Claims, 2 Drawing Sheets

Figure 1:
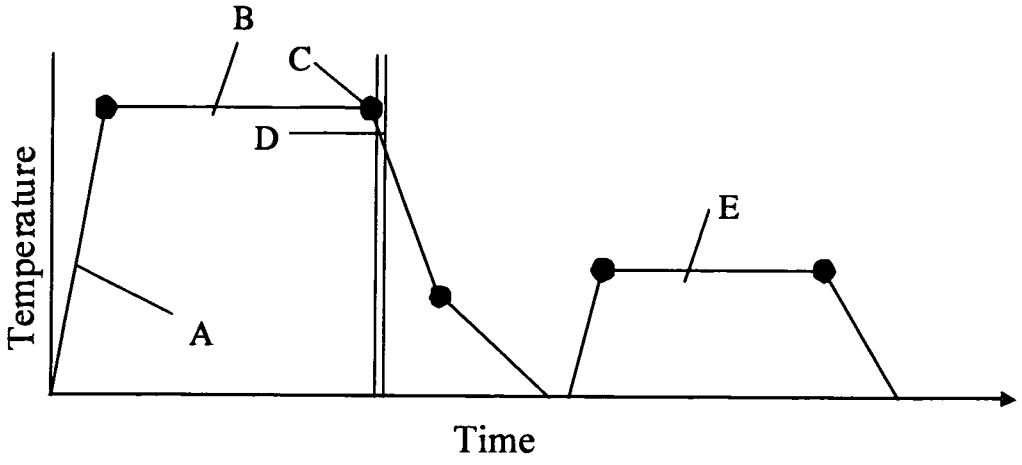

(51) Int. Cl.

| | |
|---|---|
| ***C22F 1/18*** | (2006.01) |
| ***C22F 1/06*** | (2006.01) |
| ***C22F 1/10*** | (2006.01) |

(56) References Cited

FOREIGN PATENT DOCUMENTS

| | | | |
|---|---|---|---|
| JP | 2007039714 | A2 | 2/2007 |
| WO | WO2008059242 | A2 | 5/2008 |

OTHER PUBLICATIONS

Japanese Office Action dated Nov. 19, 2013 in connection with related Japanese Patent Application No. 2011-527393.

* cited by examiner

PROCESS FOR FORMING ALUMINIUM ALLOY SHEET COMPONENTS

The present invention relates to an improved method of forming metal alloy sheet components and more particularly Al-alloy sheet components. The method is particularly suitable for the formation of formed components having a complex shape which cannot be formed easily using known techniques.

Age hardening Al-alloy sheet components are normally cold formed either in the T4 condition (solution heat treated and quenched), followed by artificial ageing for higher strength, or in the T6 condition (solution heat treated, quenched and artificially aged). Either condition introduces a number of intrinsic problems, such as springback and low formability which are difficult to solve. Hot stamping can increase formability and reduce springback, but it destroys the desirable microstructure. Post-forming heat treatment (SHT) is thus required to restore the microstructure, but this results in distortion of the formed components during quenching after SHT. These disadvantages are also encountered in forming engineering components using other materials.

In an effort to overcome these disadvantages, various efforts have been undertaken and special processes have been invented to overcome particular problems in forming particular types of components. These are outlined below:

Method 1: Superplastic Forming (SPF) of Sheet Metal Components

This is a slow isothermal gas-blow forming process for the production of complex-shaped sheet metal components and is mainly used in the aerospace industry. Sheet metals with fine grains and the forming tool are heated together. Post-forming heat-treatment (e.g. SHT+Quenching+Ageing for Heat-treatable Al-alloys) is normally required to obtain appropriate microstructure to ensure high strength. Superplastic behaviour of a material can only be observed for specific materials with fine grain size deforming at specified temperature and strain rates. (Lin, J., and Dunne, F. P. E., 2001, Modelling grain growth evolution and necking in superplastic blow-forming, *Int. J. of Mech. Sciences*, Vol. 43, No. 3, pp 595-609.)

Method 2: Creep Age Forming (CAF) of Al-Alloy Panels

Again, this is a slow process commonly used for forming aircraft wing panel parts with the combination of forming and ageing hardening treatment. The creep forming time is determined according to the requirement of artificial ageing for a material. A small amount of plastic deformation is normally applied to the process and springback is a major problem to overcome. Various techniques, such as those described in U.S. Pat. Nos. 5,168,169, 5,341,303 and 5,729,462, have been proposed for designing CAF tools for springback compensation using computers.

Method 3: Method of treating metal alloys (FR 1 556 887) was proposed for, preferably, Al-alloys and its application to extrusion of the alloys in the state of a liquid-solid mixture with a view to manufacture profiles. In this method, the proportion of liquid alloy is maintained below 40% for 5 minutes to 4 hours so that the dendritic phase has at least begun to change into globular form. Quenching is performed on the extrudate at the outlet of the die either with pulsated air or by spraying water, a mixture of air and water or mist. The formed parts are then artificially aged at a specified temperature for age hardening. This technique is difficult to be applied for sheet metal forming, since (i) the sheet becomes too soft to handle at that temperature (liquid alloy is about 40%), and, (ii) the mentioned quenching method is difficult to be applied for the formed sheet parts.

Method 4: Solution Heat Treatment, forming and cold-die quenching (HFQ) is described by the present inventors in their earlier application WO2008/059242. In this process an Al-alloy blank is solution heat treated and rapidly transferred to a set of cold dies which are immediately closed to form a shaped component. The formed component is held in the cold dies during cooling of the formed component. Further studies revealed deficiencies in this process and the present invention represents an improvement of the process described in WO2008/059242.

According to the present invention, there is provided a method of forming an Al-alloy sheet component comprising:

(i) heating an Al-alloy sheet blank to its Solution Heat Treatment temperature at a heating station and, in the case of alloys not in a pre age hardened temper, maintaining the SHT temperature until Solution Heat Treatment is complete, (ii) transferring the sheet blank to a set of cold dies and initiating forming within 10 s of removal from the heating station so that heat loss from the sheet blank is minimised, (iii) closing the cold dies to form the sheet blank into a shaped component said forming occurring in less than 0.15 s, and (iv) holding the formed component in the closed dies during cooling of the formed component.

The claimed method will find application for any alloy with a microstructure and mechanical properties that can be usefully modified by solution treatment and age-hardening.

The present invention differs from that disclosed in WO2008/059242, inter alia, by the significantly more rapid die closure. In WO2008/059242 the fastest die closure exemplified is 2 s (i.e. more than an order of magnitude slower than the slowest time contemplated by the present invention). As will be explained in more detail below, the inventors have discovered through their extensive research that such short times are critical to the success of the HFQ process.

In some embodiments, the die closure may occur in less than 0.1 s or even less than 0.05 s.

The period of holding the formed component in the cooled dies may be less than 4 s, less than 2 s or even less than 1 s depending on the thickness of the component. The period of holding need only be long enough for the formed component to reach a temperature of, for example, 250° C. or less, so that the required microstructure is maintained after removal from the dies. It will be understood that this period could be extremely short for thin materials.

As used herein, the Solution Heat Treatment (SHT) temperature is the temperature at which SHT is carried out (usually within about 50° C. of the alloy liquidus temperature). SHT involves dissolving the alloying elements as much as possible within the aluminium matrix.

Subsequent quenching in steps (ii) to (iv) prevents the formation of precipitates (i.e. the alloying components are maintained in supersaturated solution) and also prevents distortion of the formed component.

Clearly the SHT temperature will vary between alloys. However a typical temperature would be within the range 450 to 600° C. and for certain alloys within the range 500 to 550° C. In those cases where it is required to complete SHT, the SHT temperature will typically be maintained for between 20 and 60 minutes, for example 30 minutes.

In the case of pre age hardened alloys, such as those in the T4 temper, the hardening phase is held in a solid solution. If heating is sufficiently rapid, the dispersed phase will not deteriorate significantly during heating and the hardening phase will be in solution as soon as the SHT temperature is reached. Thus, in the case of pre age hardened alloys, the rate of heating to the SHT temperature may be at least 2° C./s, or even 3° C./s.

The transfer time (between heating and forming) should be as rapid as possible and in the order of seconds, for example less than 5 seconds or even less than 3 seconds.

In certain embodiments, the rate of cooling of the formed component in the dies is such that the formed component is cooled to below 200° C. in less than 10 seconds. In certain embodiments, the dies are maintained at a temperature of no higher than 150° C. Natural heat loss from the dies may be sufficient to maintain them at a sufficiently low temperature. However, additional air or water cooling may be applied if necessary.

The method may comprise an additional artificial ageing step for heat-treatable Al-alloy components comprising heating the formed component to an artificial ageing temperature and holding at that temperature to allow precipitation hardening to occur. Typical temperatures are in the range of 150 to 250° C. Ageing times can vary considerably depending on the nature of the alloy. Typical ageing times are in the range of 5 to 40 hours. For automotive components, the ageing time can be in the order of minutes, e.g. 20 minutes.

Heat treatable Al-alloys suitable for use in the process of the invention include those in the 2XXX, 6XXX and 7XXX series. Specific examples include AA6082 and 6111, commonly used for automotive applications and AA7075, which is used for aircraft wing structures.

Non-heat treatable Al-alloys suitable for use in the process of the invention include those in the 5XXX series such as AA 5754, a solution hardening alloy for which the process can offer benefits in increasing its corrosion resistance.

The invention also resides in a formed part obtained by the process of the invention. Such parts may be automotive parts such as door or body panels.

It should be noted that hot-stamping with cold-die quenching is not new per se. Such a process is known for specialist steel sheets. In the process, the steel sheet is heated sufficiently to transform it to a single austenitic phase to achieve higher ductility. On cold-die quenching the austenite is transformed to martensite, so that high strength of the formed component is achieved. This process is developed for special types of steels, which have high martensite transformation temperature with a lower cooling rate requirement and is mainly used in forming safety panel components in the automotive industry. (Aranda, L. G., Ravier, P., Chastel, Y., (2003). *The 6th Int. ESAFORM Conference on Metal Forming,* Salerno, Italy, 28-30, 199-202).

Figure 2:
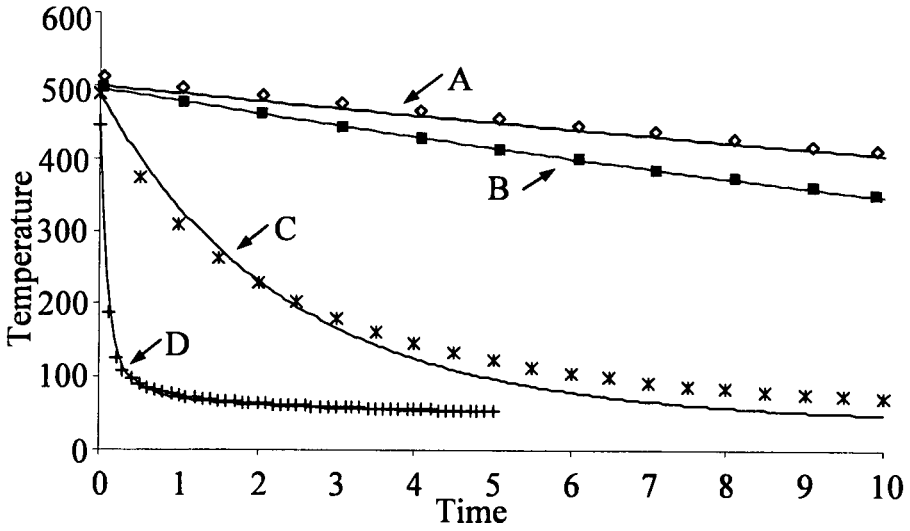
Figure 3A:
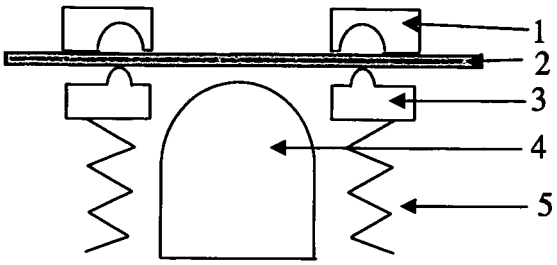
Figure 3B:
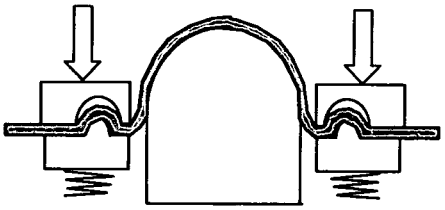
Figure 3C:
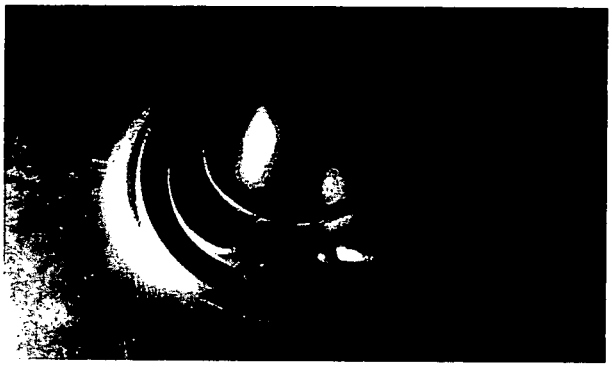
Figure 3D:
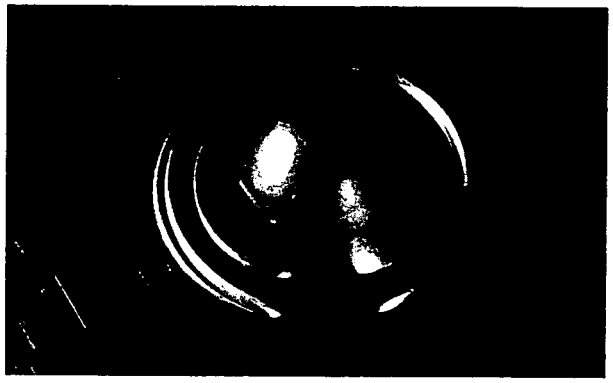

Embodiments of the invention will be further described by way of example only with reference to the accompany drawings in which:

FIG. 1 is a schematic representation of the temperature profile of a component when carrying out the method in accordance with the present invention, FIG. 2 is a plot of temperature against time for a component between flat tool steel dies, when subject to various contact gaps and pressures, FIGS. 3*a* and 3*b* show a die design used to assess the formability for various conditions, in an initial condition (FIG. 3*a*) and a post forming condition (FIG. 3*b*), FIGS. 3*c* and 3*d* show the results of 2s and 0.07 s forming processes respectively, using the die arrangement of FIG. 3*a*

The process is outlined schematically in FIG. 1. The blank is first heated to its SHT temperature (A) (e.g. 525° C. for AA6082) and the material is then held at this temperature for the required time period (e.g. 30 minutes for AA6082) if full SHT is required (B). The SHTed sheet blank is then immediately transferred to the press and placed on the lower die (C). This transfer should be quick enough to ensure minimal heat loss from the aluminium to the surrounding environment (e.g. less than 5 seconds). Once the blank is in place the top die is lowered so as to form the component (D). The heat loss during the forming process should also be minimal, achieved by ensuring the process is fast. Once fully formed the component is held between the upper and lower die until the material is sufficiently cooled, allowing the process of cold die quenching to be completed. Artificial ageing (E) is then carried out to increase the strength of the finished component (i.e. 9 hours at 190° C. for AA 6082). The ageing can be combined with a baking process if the subsequent painting of the formed product is required.

In a variant of the above process the AA6082 alloy is heated at a rate of at least 2° C./s until the SHT temperature is reached. SHT (B) is omitted and the blank immediately transferred to the press for forming.

Importantly both top and bottom dies are maintained at a temperature low enough for an efficient quench to be achieved. In the above example, the dies were maintained below 150° C. Due to aluminium alloys having a high heat transfer coefficient and low heat capacity, the heat loss from the aluminium into the cold dies and surrounding environment will be great, providing high quenching rates. This allows the supersaturated solid solution state to be maintained in the quenched state.

The key parameter for success of the forming process is a sufficiently high cooling rate in the cold-die quenching, so that the formation and the growth of precipitates can be controlled. Thus, high strength sheet metal parts can be manufactured after artificial ageing. Cold-die quenching is not traditionally practised on precipitation hardening alloys, since water-quenching is normally required to achieve high cooling rates economically, so that the formation of precipitates can be avoided at grain boundaries at this stage of the heat treatment. Since the alloys in question are capable of precipitation hardening, the quenching with cold-die in fact keeps the maximum amount of elements, which are capable of precipitation when aged, in solid solution in order to improve the properties. The effect of cold die quenching (cooling rate) is directly related to the die temperature in operation, Al-alloy sheet thickness and contact conditions (such as forming pressure, clearance surface finish and lubricant). Mechanical tests were carried out to investigate if the cooling rate using cold die-quenching is sufficient to achieve the mechanical properties of the heat treated materials.

Test 1—Quenching Between Flat Tool-Steel Dies

In this investigation, 3 cooling methods have been used and the results are compared. Firstly the samples of AA6082 sheet with thickness of 1.5 mm were heated to 525° C. and kept for 30 minutes for SHT. Then the samples were either (i) water quenched, (ii) quenched between flat cold-steel dies, and, (iii) quenched with air (natural cooling). For quenching between the flat cold-steel dies, a circular disc of the alloy sheet was placed between correspondingly shaped dies. A temperature probe was attached to the alloy sheet towards its periphery to monitor its temperature profile. Various conditions were investigated by applying spacers of varying thickness between the sheet and the dies or having the sheet in contact with the dies and applying varying loads onto the top die. The samples were then aged at 190° C. for 9 hours.

Tensile tests were carried out for samples SHTd and quenched by various means and the results are given in Table 1. The cold-die quenching without pressure applied (other than from the weight of the die) resulted in an ultimate tensile stress 95% the value obtained by the water quenching, which is generally thought to give the best hardening response.

TABLE 1 strength measurements for different quenching methods

| | Yield Strength | | Ultimate Strength | | Ductility | |
|---|---|---|---|---|---|---|
| Quench Method | $\sigma_y$ (MPa) | % WQ | $\sigma_u$ (MPa) | % WQ | $\varepsilon_f$ (%) | % WQ |
| Water Quenched | 230 | — | 305 | — | 0.17 | — |
| Cold Die Quenched[1] | 200 | 87 | 290 | 95 | 0.18 | 106 |
| Air Quenched | 122 | 53 | 210 | 69 | 0.22 | 129 |

[1]0.0 mm gap distance, no additional force applied.

The temperature profile observed during cold die quenching is given in FIG. 2. Plots A to C are at die gaps of 1.05 mm, 0.6 mm and 0.0 mm respectively. Plot D is at a gap of 0.0 mm with a load of 170 MPa applied to the top die. It can be seen from FIG. 2 that the fastest cooling is observed when there is good contact between the alloy sheet and the dies.

Test 2—Forming of Hemispherical Components

The tool set-up is schematically represented in FIG. 3*a*. The blank 2 AA6082—heated to 525° C., and subsequently cooled to 450° C.—was laid on the lower blank holder 3 and held between the lower blank holder 3 and the upper blank holder 1 with the force in springs 5. The blank was punched into a hemispherical shape by the punch 4 (the speed of punching being controlled to define the forming time) and held in the die set for 10 seconds (FIG. 3*b*). In this investigation two forming periods (i.e. 0.07, 2 seconds) were used for forming the same Al-alloy sheet material. The initial die temperature was 22° C. and no artificial cooling of the die was used. The forming depth was 23 mm, which is characteristic of a typical industrial application.

The comparative example which is formed in 2 s fails as shown by the tearing in the dome shown in FIG. 3*c*. While high ductility is achieved, this does not extend to good formability. Ductility is the ability for a material to withstand deformation without failure. Formability is the ability to create shape in a material without failure. For the current case, formability can be thought of as the ability to have a uniform, ductile deformation over the forming area. In the comparative example, the deformation quickly localised causing early failure, even though a ductile response is observed.

There are two mechanisms that act to improve the formability when speed is increased:

1. Towards a Uniform Temperature Profile

This is directly concerned with the forming time, since the sheet will start to rapidly locally quench as soon as regions make contact with the cold die. Quench speeds of up to 500° C./s have been found under conditions envisaged as typical for a HFQ operation, which leads to thermal gradients of several hundred degrees across the sheet. This is much greater than the inventors had hitherto realised. By forming over an extremely short period, the heat transfer during the forming part of the process is minimised, and the temperature profile over the workpiece is kept close to uniform. The exact temperature drop will depend on the thermal contact between the sheet and die and the thickness of the sheet.

2. Towards a Better Material Flow Stress Response

When common sheet metals are deformed at room temperature, they experience work hardening. The material becomes stronger as it is deformed and so the deforming region will quickly redistribute if more deformation occurs in one region than another. It is this work hardening mechanism that translates a material's good ductility into good formability. At high temperature, aluminium has very little work hardening and so localisation quickly occurs and is not counteracted by a strengthening material. Fortunately, aluminium has a viscoplastic (rate dependent) flow stress response at high temperatures. If a region is deforming considerably faster than its neighbouring regions, the relative strength will be higher and this will redistribute the deformation to some extent. Also, by increasing the overall speed of the process, the material will have a higher flow stress which 'pulls' the material around the die more effectively. Finally, work hardening will be most prominent at higher deformation rates, maximising what little work hardening there is. This is concerned with the forming speed, which links to forming time through the forming depth.

The invention claimed is:

1. A method of forming a component having a complex shape from an Al-alloy sheet comprising sequentially:

(i) heating an Al-alloy sheet blank to its Solution Heat Treatment (SHT) temperature at a heating station and maintaining the SHT temperature until Solution Heat Treatment is complete, (ii) transferring the sheet blank to a set of cold dies and initiating forming within 10s of removal from the heating station so that heat loss from the sheet blank is minimised, (iii) closing the cold dies in less than 0.15s, which includes fully forming the sheet blank into the complex-shaped component at low heat loss whereby to deform selected regions faster than neighboring regions thereby increasing the strength of the selected regions relative to the neighboring regions, and (iv) thereafter subjecting the formed component to a quenching phase by holding the fully formed component in the closed dies at a gap of from 0.0 mm to 1.05 mm, during cooling of the formed component.

2. A method according to claim 1, wherein the period of holding the formed component in the closed dies is long enough for the formed component to reach a temperature of 250° C. or less.

3. A method according to claim 2, wherein the period of holding the formed component in the closed dies is less than 4s.

4. A method according to claim 1, wherein the temperature for the Solution Heat Treatment (SHT) is within the range 450 to 600° C.

5. A method according to claim 4, wherein the temperature for the Solution Heat Treatment (SHT) is within the range 500 to 550° C.

6. A method according to claim 1, wherein the SHT temperature is maintained for between 20 and 60 minutes.

7. A method according claim 1, wherein the rate of heating to the SHT temperature is at least 2° C./s.

8. A method according to claim 1, wherein the transfer time of the sheet blank to the cold dies is less than 5s.

9. A method according to claim 1, wherein the formed component is cooled to below 200° C. in less than 10 seconds.

10. A method according to claim 1, wherein the dies are maintained at a temperature of no higher than 150° C.

11. A method according claim 1, comprising an additional artificial ageing step of heating the formed component to an artificial ageing temperature and holding the formed component at that temperature to allow precipitation hardening to occur.

12. A method according to claim 1, carried out on a heat treatable Al-alloy in the 2XXX, 6XXX and 7XXX series.

13. A method according to claim 1, carried out on a non-heat treatable Al-alloy in the 5XXX series.

14. A method according to claim 1 wherein the gap is 0.0 mm.

* * * * *